US006322321B1

(12) United States Patent
Magoshi et al.

(10) Patent No.: US 6,322,321 B1
(45) Date of Patent: Nov. 27, 2001

(54) NOZZLE CHAMBER WARMING-UP STRUCTURE FOR A STEAM TURBINE

(75) Inventors: Ryotaro Magoshi; Takashi Nakano, both of Takasago (JP)

(73) Assignee: Mitsubishi Heavy Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/428,383

(22) Filed: Oct. 28, 1999

(51) Int. Cl.[7] ..... F01D 9/02; F01D 25/10

(52) U.S. Cl. ..... 415/185; 415/199.5; 415/176; 415/201

(58) Field of Search ..... 415/115, 201, 415/176, 177, 178, 155, 184, 199.5, 185

(56) References Cited

U.S. PATENT DOCUMENTS 1,286,204 * 12/1918 Baumann ..... 415/185
1,311,547 * 7/1919 Baumann ..... 415/185
2,294,127 * 8/1942 Pentheny ..... 415/155
3,176,958 4/1965 Pametrada .

FOREIGN PATENT DOCUMENTS

535559 * 4/1941 (GB) ..... 415/185
09013909 1/1997 (JP) .

* cited by examiner

*Primary Examiner*—Edward K. Look
*Assistant Examiner*—Richard Woo
(74) *Attorney, Agent, or Firm*—Alston & Bird LLP

(57) ABSTRACT

A nozzle chamber warming-up structure comprises a ring mounted about a rotor of the turbine and defines an annular space surrounding the rotor. The annular spaced is divided by dividing walls into a plurality of steam chambers distributed circumferentially about the rotor, including first ad second upper steam chambers and at least one lower steam chamber. The dividing wall have holes such that steam supplied into the first upper steam chamber flows through the hole in one of the dividing walls into the one or more lower steam chambers, and then flows through The hole in another of the dividing walls into the second upper steam chamber. The steam that flows circumferentially around the ring and warms up the nozzle chamber uniformly.

4 Claims, 5 Drawing Sheets

NOZZLE CHAMBER WARMING-UP STRUCTURE FOR A STEAM TURBINE

FIELD OF THE INVENTION AND RELATED ART STATEMENT

The present invention relates to a nozzle chamber warming-up structure for a steam turbine. More particularly, it relates to a nozzle chamber warming-up structure for a steam turbine, in which a nozzle chamber is warmed uniformly in the warming-up process to prevent an excessive contact of a seal portion of a dummy ring, with which the nozzle chamber is formed integrally, with a rotor.

FIG. 3 is a sectional view showing a prior art structure of a main steam introducing portion for a steam turbine. In FIG. 3, a reference numeral 11 denotes a main steam inlet port, 12 denotes a casing, and 13 denotes a rotor. A dummy ring 14 is disposed around the rotor 13, and a seal portion 15 is provided between the dummy ring 14 and the periphery of the rotor 13. A nozzle chamber 16 is formed around the rotor 13 integrally with the dummy ring 14, and has nozzles 17. The nozzle chamber 16 introduces main steam 30 through the main steam inlet port 11, and supplies steam to a high pressure turbine section 20 through the nozzles 17.

FIG. 3 is a sectional view showing a structure of a main steam introducing portion for a steam turbine relating to the present invention. In FIG. 3, reference numeral 11 denotes a main steam inlet port, 12 denotes a casing, and 13 denotes a rotor. A dummy ring 14 is disposed around the rotor 13, and a seal portion 15 is provided between the dummy ring 14 and the periphery of the rotor 13. A nozzle chamber 16 is formed around the rotor 13 integrally with the dummy ring 14, and has nozzles 17. The nozzle chamber 16 introduces main steam 30 through the main steam inlet port 11, and supplies steam to a high pressure turbine section 20 through the nozzles 17.

Reference numeral 18 denotes a stator blade of one stage in the high pressure turbine section 20, and 19 denotes a rotor blade of one stage fixed to the rotor 13 in the high pressure turbine section 20. Thus, the high pressure turbine section 20 has the dummy ring 14, many stator blades fixed to the periphery of inside wall of the casing 12, and many rotor blades fixed to the periphery of the rotor 13, and a steam passage is formed by alternately arranging these stator blades and rotor blades in the axial direction.

FIG. 4 is a sectional view taken along the line B—B of FIG. 3. The construction is such that steam inlets 21 and 22 are provided to introduce the main steam 30 to the nozzle chamber 16, and a steam chamber is divided into four chambers denoted by 23*a*, 23*b*, 23*c* and 23*d* by means of ribs 24*a*, 24*b*, 24*c* and 24*d*.

FIG. 5 is a sectional view taken along the line C—C of FIG. 3. The nozzle chamber 16 is vertically divided into two chambers, which are combined with each other. The nozzles 17 are provided only in the upper half of the nozzle chamber 16, constituting partial insertion type nozzles. This is because the cross sectional area of steam passage is increased by halving the inflow area of nozzle with respect to a certain amount of inflow steam.

In the steam turbine configured as described above, the main steam 30 enters the casing 12 through the steam inlet port 11, being introduced into the nozzle chamber 16, and is blown off to the steam passage of the high pressure turbine section 20 through the nozzles 17 provided in the upper half of the nozzle chamber 16. The steam blown off from the nozzles 17 passes through the one-stage stator blade 18 and rotor blade 19 of the high pressure turbine section 20, flows in a space between the stator blades and the rotor blades arranged in a multi-stage form, and drives the rotor 13 to do work. Thereafter, the steam is discharged through an exhaust system (not shown).

The dummy ring 14 is disposed around the rotor 13 between the high pressure turbine section 20 and the adjacent intermediate pressure turbine section, and provides a seal between both of the turbine sections to prevent a leak of steam from the high pressure side to the intermediate pressure side.

The nozzle chamber 16 of a partial insertion type in the above-described turbine has a construction such that the introduced main steam enters the steam chambers 23*a* and 23*d* in the upper half through the steam inlets 21 and 22 as shown in FIGS. 4 and 5, and flows out to the steam passage of the high pressure turbine section 20 through nozzles 17 provided in the upper half as shown in FIG. 5, but the main steam does not flow into the steam chambers 23*b* and 23*c* in the lower half. Therefore, for the nozzle chamber 16, the effect of thermal deformation differs between the upper-half steam chambers 23*a* and 23*d* into which the steam flows and the lower-half steam chambers 23*b* and 23*c* into which the steam does not flow, so that nonuniform thermal deformation occurs.

As described above, in the nozzle of a partial insertion type of the steam turbine relating to the present invention, there is a great difference in thermal expansion between the upper-half steam chambers 23*a* and 23*d* into which the steam flows and the lower-half steam chambers 23*b* and 23*c* into which the steam does not flow, so that the whole is not deformed uniformly, and nonuniform thermal deformation occurs. Therefore, the seal portion 15 of the dummy ring 14 integrated with the nozzle chamber 16 comes excessively into contact with the rotor 13. As a result, vibrations sometimes occur. To avoid this trouble, warm-up is performed. However, because the ribs 24*b*, 24*c* and 24*d* are present, the lower-half steam chambers 23*b* and 23*c* cannot be warmed up, and only the upper half is warmed up. Therefore, it is difficult to warm up the whole of the nozzle chamber uniformly.

OBJECT AND SUMMARY OF THE INVENTION

Accordingly, an object of the present invention is to provide a nozzle chamber warming-up structure that can warm up the whole of nozzles uniformly in the warming-up process in a partial insertion type nozzle chamber in which a steam chamber of a steam turbine is divided, in order to prevent nonuniform thermal deformation of the nozzle chamber and to prevent vibrations caused by an excessive contact of a dummy ring provided integrally with the nozzle chamber with a rotor caused by this nonuniform thermal deformation.

To solve the aforementioned problems, the present invention provides the following means.

In a nozzle chamber warming-up structure for a steam turbine, in which a nozzle chamber for introducing main steam to the periphery of a rotor is provided, the nozzle chamber is divided into four steam chambers, and main steam is caused to flow out to a steam passage of a turbine through nozzles disposed so as to correspond to the steam chambers in the upper half of the nozzle chamber, through holes are formed in walls dividing the steam chamber so that the divided steam chambers communicate with each other via the through holes, by which warming-up steam is made capable of flowing in the steam chambers.

In the nozzle chamber warming-up structure in accordance with the present invention, in the warming-up process, warming-up steam is introduced into the nozzle chamber, and is caused to flow to the steam chambers in the nozzle chamber in succession to warm up the steam chambers uniformly. Conventionally, the construction is such that two inlets of main steam to the partial insertion type nozzle chamber are provided at right and left, and steam flows in through these inlets uniformly, and flows out to the steam passage through the nozzles disposed in the upper half of the nozzle chamber. For such a construction, the steam chambers are divided, and the warming-up steam cannot be caused to flow to the lower-half steam chamber into which the steam does not flow, so that it is difficult to warm up the whole of the nozzle chamber uniformly.

In the present invention, through holes are formed to cause steam spaces to communicate with each other, and further the angles of nozzle blades are changed at right and left to provide unbalance, by which the steam outflow amount is changed at right and left, and a difference in pressure is provided in the right and left steam chambers. Thereby, the warming-up steam can be caused to flow easily between the steam chambers.

As described above, the present invention achieves the following effects.

In a nozzle chamber warming-up structure for a steam turbine in accordance with the present invention, in which a nozzle chamber for introducing main steam to the periphery of a rotor is provided, the nozzle chamber is divided into four steam chambers, and main steam is caused to flow out to a steam passage of a turbine through nozzles disposed so as to correspond to the steam chambers in the upper half of the nozzle chamber, through holes are formed in walls dividing the steam chamber so that the divided steam chambers communicate with each other via the through holes, by which warming-up steam is made capable of flowing in the steam chambers. By this configuration, since the warming-up steam can pass through the steam chambers through the through holes, the whole of the nozzle chamber can be warmed up uniformly, and nonuniform thermal expansion can be restrained. As a result, a contact of the dummy ring integral with the nozzle chamber with the rotor caused by the nonuniform thermal deformation can be avoided, and the occurrence of vibrations caused by this contact can be prevented.

DETAILED DESCRIPTION OF PREFERRED EMBODIMENTS

Figure 1:
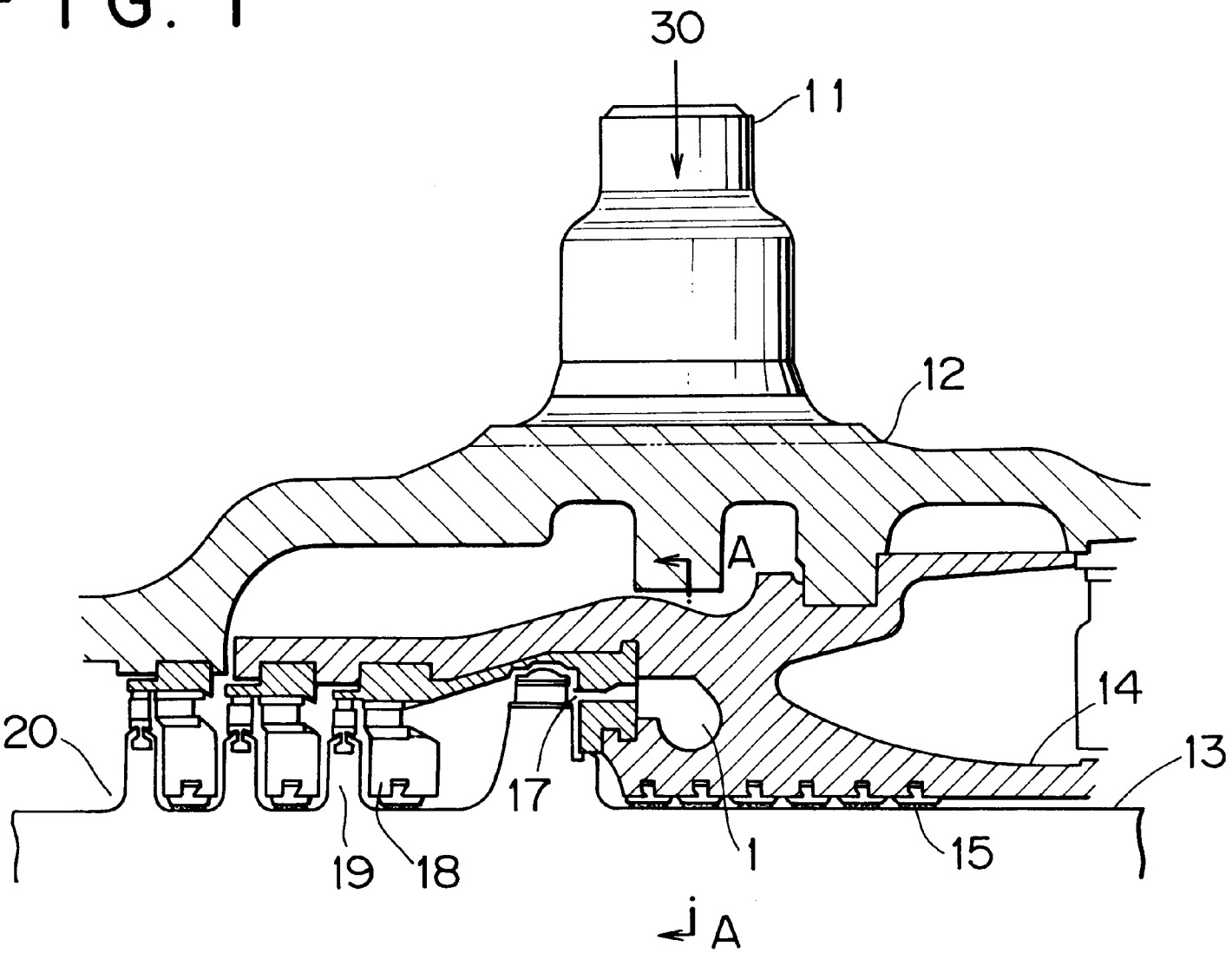
FIG. 1 is a sectional view of the vicinity of a nozzle chamber for a steam turbine to which a nozzle chamber warming-up structure for a steam turbine in accordance with one embodiment of the present invention is applied.

An embodiment of the present invention will now be described with reference to the accompanying drawings. FIG. 1 is a sectional view of a nozzle chamber warming-up structure for a steam turbine in accordance with one embodiment of the present invention. In this figure, elements other than the nozzle chamber 1 are the same as those shown in FIG. 3, so that the description of the construction and operation of the whole structure is omitted and the same reference numerals are applied to the same elements as those in FIG. 3, and the nozzle chamber 1 is described in detail.

Figure 2:
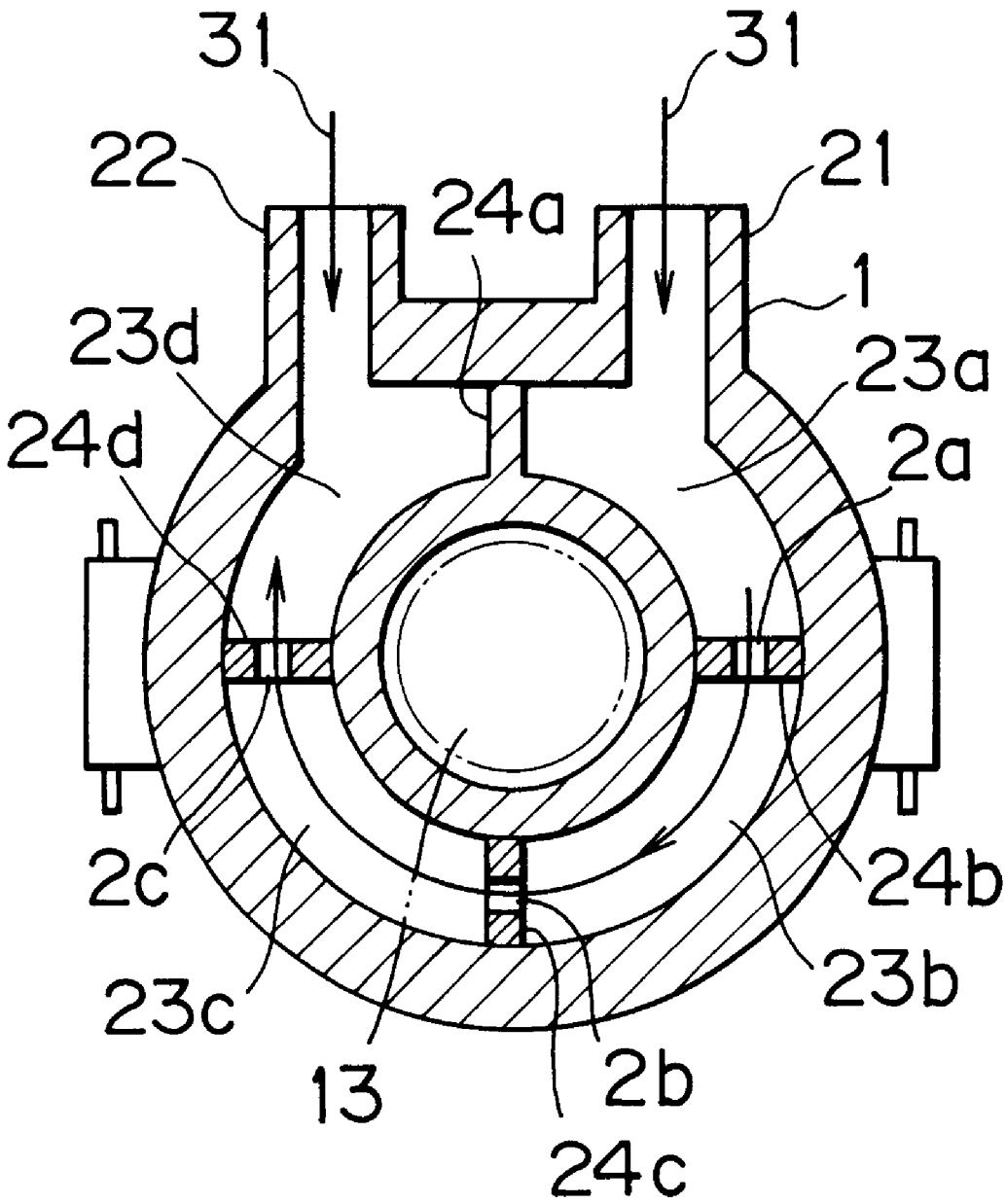
FIG. 2 is a sectional view taken along the line A—A of FIG. 1.

The details of the nozzle chamber 1 in FIG. 1 are shown in across section A—A of FIG. 2. In FIG. 2, the nozzle chamber 1 is divided by ribs 24*a*, 24*b*, 24*c* and 24*d*, and steam chambers divided into four chambers of 23*a*, 23*b*, 23*c* and 23*d* are provided. The ribs 24*b*, 24*c* and 24*d* are formed with through holes 2*a*, 2*b* and 2*c*, respectively, and the steam chambers 23*a*, 23*b*, 23*c* and 23*d* communicate in succession by means of the through holes 2*a*, 2*b* and 2*c*.

In the nozzle chamber 1 configured as described above, as in the case of FIG. 3, main steam 31 flows in through the steam inlets 21 and 22 uniformly. Since the nozzles 17 are provided in the upper half in the same manner as in the case of FIG. 3, most of the main steam is blown off to the steam passage of the high pressure turbine section 20 through the nozzles 17 provided in the upper half, and functions as in the case of FIG. 3.

In the warm-up process before the operation, warming-up steam 31 flows in through the steam inlets 21 and 22 as shown in FIG. 2. Since the steam 31 flows in through the right and left steam inlets 21 and 22 uniformly, in this state, the warming-up steam 31, like the main steam 30, flows out through the nozzles 17 provided in the upper half corresponding to the right and left steam chambers 23*a* and 23*d*, and scarcely flow into the lower-half steam chambers 24*b* and 24*c*. Therefore, the angles of blades of the upper-half nozzles 17 at a portion corresponding to the steam chambers 23*a* and 23*d* are somewhat changed at right and left so that the steam outflow amount of nozzles 17 corresponding to the steam chambers 23*a* and 23*d* is made somewhat unbalanced at right and left.

If the angles of the nozzle blades are changed at right and left as described above to change the steam outflow amount at right and left so that, for example, the pressure in the steam chamber 23*a* is slightly higher than that in the steam chamber 23*d*, as shown in FIG. 2, the warming-up steam 31 flowing in through the steam inlet 21 enters the steam chamber 23*b* through the through hole 2*a*, flows into the steam chamber 23*c* through the through hole 2*b*, flows into the steam chamber 23*d* through the through hole 2*c*, and then flows out to the steam passage from the left side of the nozzles 17 (not shown).

The warming-up steam 31 flowing in through the steam inlet 22, being combined with the steam flowing in through the hole 2*c*, flows out to the steam passage from the left side of the nozzles 17. Thus, in this embodiment, in the warming-up process, the warming-up steam 31 flows in the steam chambers 23*a*, 23*b*, 23*c* and 23*d* in succession via the through holes 2*a*, 2*b* and 2*c*, and can warm whole of the nozzle chamber 1 uniformly. Therefore, even after the operation, nonuniform thermal deformation of the nozzle chamber 1 can be restrained, so that an excessive contact of the seal portion 15 of the dummy ring 14 integrated with the nozzle chamber 1 with the rotor 13 can be avoided, which prevents vibrations caused by this contact.

What is claimed is:

1. A nozzle chamber warming-up structure for a steam turbine of the type having a rotor and a turbine section mounted on the rotor, the nozzle chamber warming-up structure comprising:

a ring adapted to be mounted about the rotor adjacent the turbine section, the ring defining a nozzle chamber therein, the nozzle chamber being of generally annular configuration so as to surround the rotor and having dividing walls dividing the nozzle chamber into a plurality of steam chambers distributed circumferentially about the ring, the steam chambers including first and second upper steam chambers and one or more lower steam chambers, the ring further defining nozzles arranged to discharge steam from said first and second upper steam chambers into the turbine section, and wherein the dividing walls define holes therethrough so that the steam chambers communicate with each other via the holes, the steam chambers and dividing walls being arranged such that steam supplied into the first upper steam chamber flows through the hole in one of the dividing walls into the one or more lower steam chambers and then flows from the one or more lower steam chambers through the hole in another of the dividing walls into the second upper steam chamber.

2. The nozzle chamber warming-up structure of claim 1, wherein the dividing walls divide the nozzle chamber into four steam chambers including the first and second upper steam chambers and first and second lower steam chambers.

3. A method for warming up a nozzle chamber of a steam turbine of the type having a rotor and a turbine section mounted on the rotor, the method comprising:

providing a ring mounted about the rotor adjacent the turbine section, the ring defining a nozzle chamber therein, the nozzle chamber being of generally annular configuration so as to surround the rotor and having dividing walls dividing the nozzle chamber into a plurality of steam chambers distributed circumferentially about the ring, the steam chambers including at least left and right upper steam chambers and one or more lower steam chambers, the ring further defining nozzles arranged to discharge steam from said upper steam chambers into the turbine section;

providing the dividing walls to have holes therethrough such that the steam chambers communicate with one another via the holes;

supplying steam into the upper steam chambers;

causing a steam pressure differential between the left and right upper steam chambers such that steam flows from a first one of the upper steam chambers having a relatively higher steam pressure, through the holes in the dividing walls and through the lower steam chambers and into a second one of the upper steam chambers having a relatively lower steam pressure, whereby steam is caused to flow circumferentially about the nozzle chamber through all of the steam chambers.

4. The method of claim 3, wherein the steam pressure differential between the left and right upper steam chambers is caused by discharging steam into the turbine section from the first of the upper steam chambers via first nozzles and discharging steam into the turbine section from the second of the upper steam chambers via second nozzles, and by providing the first nozzles to pass a lesser steam flow rate than the second nozzles.

* * * * *

UNITED STATES PATENT AND TRADEMARK OFFICE

CERTIFICATE OF CORRECTION

PATENT NO. : 6,322,321 B1 
DATED : November 27, 2001
INVENTOR(S) : Magoshi et al.

It is certified that error appears in the above-identified patent and that said Letters Patent is hereby corrected as shown below:

Title page,
Item [57], ABSTRACT,
Line 5, "ad" should read -- and --;
Line 7, "wall" should read -- walls --;
Line 10, "The" should read -- the --;
Line 12, "that" should read -- thus --.

Figure 3:
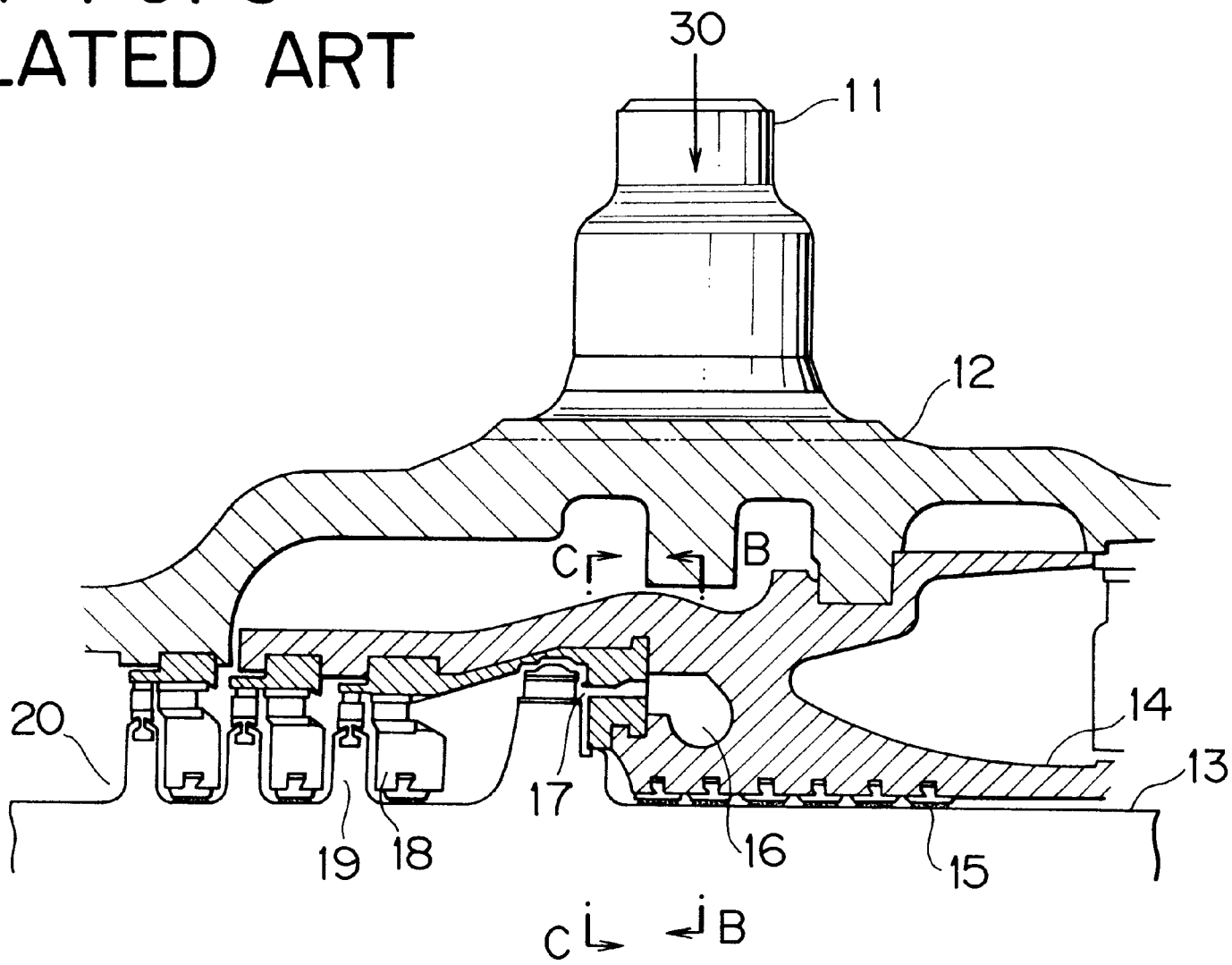
FIG. 3 RELATED ART
FIG. 3 is a sectional view of the vicinity of a nozzle chamber for a steam turbine, which relates to the present invention.
Figure 4:
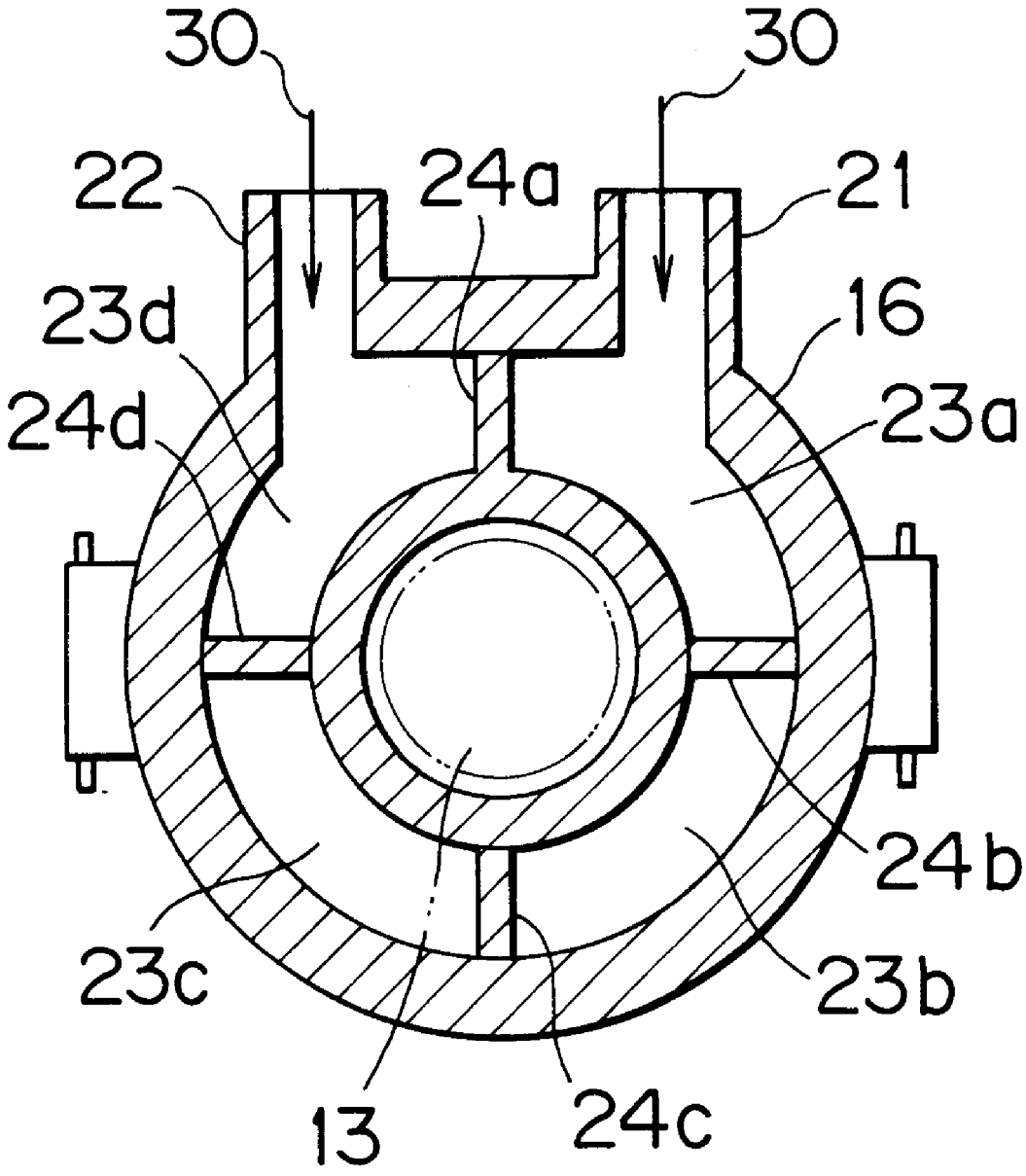
FIG. 4 RELATED ART
FIG. 4 is a sectional view taken along the line B–B of FIG. 3.
Figure 5:
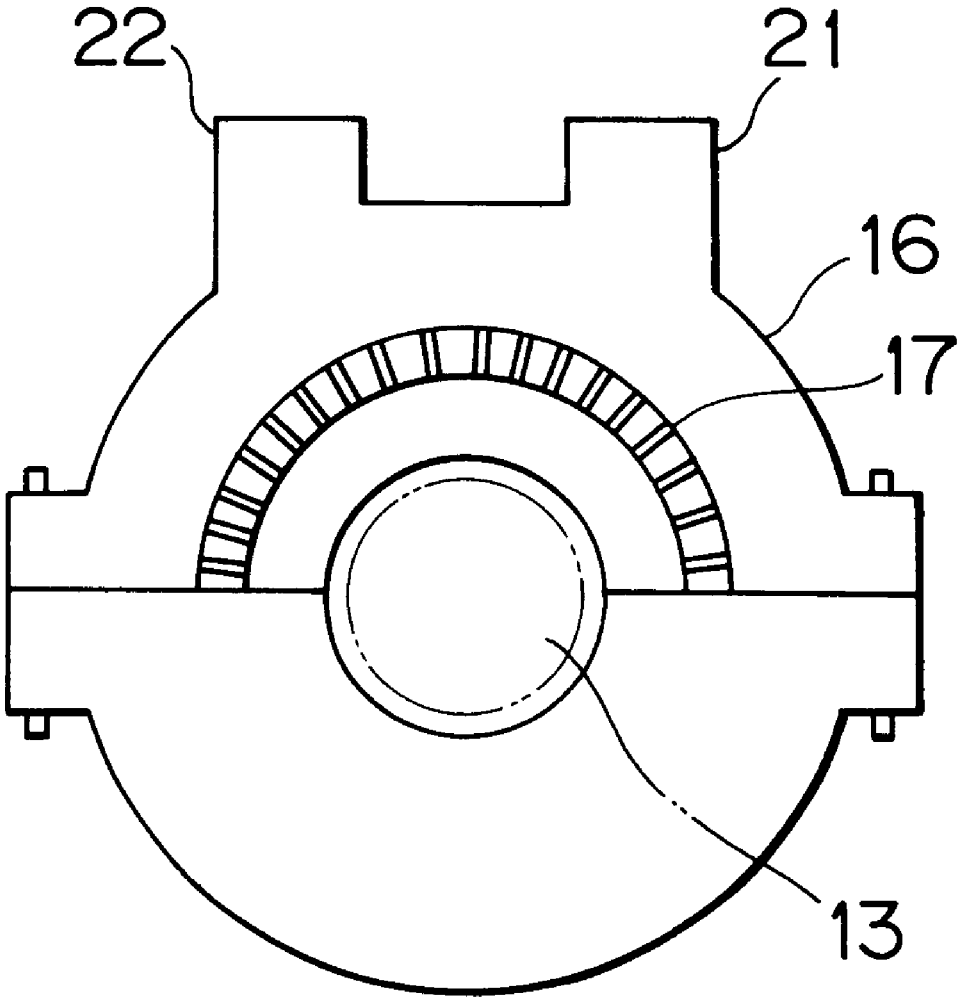
FIG. 5 RELATED ART
FIG. 5 is a sectional view taken along the line C—C of FIG. 3.

Column 1,
Cancel lines 24-35:
"FIG. 3 is a sectional view showing a structure of a main steam introducing portion for a steam turbine relating to the present invention. In FIG. 3, reference numeral 11 denotes a main steam inlet port, 12 denotes a casing, and 13 denotes a rotor. A dummy ring 14 is disposed around the rotor 13, and a seal portion 15 is provided between the dummy ring 14 and the periphery of the rotor 13. A nozzle chamber 16 is formed around the rotor 13 integrally with the dummy ring 14, and has nozzles 17. The nozzle chamber 16 introduces main steam 30 through the main steam inlet port 11, and supplies steam to a high pressure turbine section 20 through the nozzles 17."
and insert:
-- FIG. 3 is a sectional view showing a prior art structure of a main steam introducing portion for a steam turbine. In FIG. 3, a reference numeral 11 denotes a main steam inlet port, 12 denotes a casing, and 13 denotes a rotor. A dummy ring 14 is disposed around the rotor 13, and a seal portion 15 is provided between the dummy ring 14 and the periphery of the rotor 13. A nozzle chamber 16 is formed around the rotor 13 integrally

UNITED STATES PATENT AND TRADEMARK OFFICE

CERTIFICATE OF CORRECTION

PATENT NO. : 6,322,321 B1
DATED : November 27, 2001
INVENTOR(S) : Magoshi et al.

It is certified that error appears in the above-identified patent and that said Letters Patent is hereby corrected as shown below:

Column 1, lines 24-35 cont'd.
with the dummy ring 14, and has nozzles 17. The nozzle chamber 16 introduces main steam 30 through the main steam inlet port 11, and supplies steam to a high pressure turbine section 20 through the nozzles 17. --

Signed and Sealed this

Thirtieth Day of July, 2002

*Attest:*

*Attesting Officer*

JAMES E. ROGAN
*Director of the United States Patent and Trademark Office*